US005425498A

United States Patent [19]

Hallam

[11] Patent Number: 5,425,498

[45] Date of Patent: Jun. 20, 1995

[54] CONTAINER HAVING IN-TURNED FLANGE

[76] Inventor: Derek Hallam, 96 Crow Tree Lane, Daisy Hill, Bradford, West Yorkshire BD8 0AN, United Kingdom

[21] Appl. No.: 267,249

[22] Filed: Jun. 29, 1994

[30] Foreign Application Priority Data

Jul. 1, 1993 [GB] United Kingdom ..... 9313578

[51] Int. Cl.[6] ..... B65D 3/14

[52] U.S. Cl. ..... 229/4.5; 229/5.5; 229/198.2

[58] Field of Search ..... 229/1.5 B, 4.5, 5.5, 229/104, 198.2; 220/408, 410, 416, 418

[56] References Cited

U.S. PATENT DOCUMENTS

| | | | |
|---|---|---|---|
| 1,916,519 | 7/1933 | Madsen et al. | 229/5.5 |
| 2,016,863 | 10/1935 | La Grua | 229/5.5 |
| 2,053,680 | 9/1936 | Page | 229/5.5 |
| 2,166,265 | 7/1939 | Ressinger | 229/5.5 |
| 2,226,178 | 12/1940 | Page | 229/5.5 |
| 2,331,901 | 10/1943 | Fisher | 229/5.5 |
| 2,389,547 | 11/1945 | Ringler | 229/5.5 |
| 2,402,944 | 7/1946 | Braloff | 229/5.5 |
| 3,670,946 | 6/1972 | Croley | 229/5.5 |
| 3,923,233 | 12/1975 | Smith | 229/5.5 |
| 4,934,591 | 6/1990 | Bantleon | 229/4.5 |

FOREIGN PATENT DOCUMENTS

| | | |
|---|---|---|
| 2836271 | 3/1979 | Germany . |
| 660439 | 11/1951 | United Kingdom . |
| 2017042 | 10/1979 | United Kingdom . |
| 2049630 | 12/1980 | United Kingdom . |

*Primary Examiner*—Gary E. Elkins
*Attorney, Agent, or Firm*—Spencer, Frank & Schneider

[57] ABSTRACT

A cardboard container of substantially rigid construction comprises a peripheral wall panel defining a hollow body, the wall panel including an in-turned flange formed along a peripheral edge thereof, the flange extending continuously along an entire length of the peripheral edge of the wall panel and being foldably and integrally connected to the wall panel by a continuous score line, the flange further having opposite ends held in abutment with one another within the hollow body such that the flange is held in a state of compression and retained within the hollow body in face-to-face engagement with the wall panel without otherwise being secured to the wall panel; and a transverse member being retained within the hollow body by the flange.

5 Claims, 2 Drawing Sheets

CONTAINER HAVING IN-TURNED FLANGE

BACKGROUND TO THE INVENTION

1. Field of the Invention

This invention relates to containers made of cardboard or like materials and which, at least in use, are of substantially rigid construction, comprising at least a peripheral wall which defines a hollow body and extends around and supports a disc-like transverse member within the body. In a simple example, the body may be of cylindrical form and the transverse member may be a circular disc which is retained within the body adjacent to one end thereof to form an open-topped container, the disc forming the base of the cylindrical container.

However, the peripheral wall can be formed into other body shapes, including oval, rectangular, and complex shapes as required, with the transverse member being of corresponding peripheral shape.

Whilst a simple open-topped container can be formed in this way, with the transverse member serving as the base of the container, it will be appreciated that a closure element or lid for a container may be formed in a similar manner, with the transverse member then serving as the top of the closure element.

Normally, the transverse member will serve to close one end of the body completely, but in some cases the transverse member may be apertured, e.g. of annular form, and in some cases it may be disposed at a position substantially spaced from an end of the body, e.g. midway between the opposed ends of the body.

In all such cases, the combination of the peripheral wall and transverse member will form a substantially rigid container, although prior to the assembly of the transverse member with the peripheral wall, the latter may be flexible or foldable.

2. Description of Prior Art

In known containers of this kind, the transverse member is usually located on an internal ledge, which may be formed by an in-turned peripheral flange around the body formed by the wall, or by a separate internal band secured within the body. Normally it has been the practice to secure such in-turned flange adhesively or otherwise to the inner face of the peripheral wall.

For example, British Patent specification No. 2017042 shows a container formed in this way, but with the in-turned flange formed with interrupted slits extending from its free edge to the edge at which it is foldably and integrally connected to the peripheral wall panel. Such slits are provided to prevent buckling as the wall panel is brought into the required cylindrical condition when opposite ends thereof are secured together by means of an overlapping glue flap. The internal flange does not extend over the glue flap, but at its opposite ends is inclined at complementary angles so that as the glue flap is brought into overlapping relation with the opposite end of the peripheral wall panel the inclined opposite ends of the in-turned flange may abut one another to ensure that the ends of the wall panel register correctly. Because of the slit construction, such in-turned flange must be secured in place adhesively.

German Patent Specification 2836271 shows a container in which a transverse member is located on an in-turned flange which is not adhesively secured to the inner face of the wall panel, but it is evident that the in-turne flange does not lay neatly against the wall panel and has a somewhat unsightly appearance. Moreover, it is free to spring away from the inner face of the wall panel.

SUMMARY OF THE INVENTION

According to the invention we provide a container made of cardboard or like material and which is of substantially rigid construction, comprising a peripheral wall panel which defines a hollow body, and further comprising a disc-like transverse member located within the body by means of an in-turned flange which is formed along a peripheral edge of the wall panel, wherein the flange extends without interruption along the entire length of the peripheral edge of the wall panel and is foldably and integrally connected to the wall panel by means of a continuous score line, and opposite ends of the flange, when in-turned, are brought into end-to-end abutment within the body so that the in-turned flange is held in a state of compression and retained within the body in face-to-face engagement with the peripheral wall panel without otherwise being secured to such wall panel.

BRIEF DESCRIPTION OF THE DRAWINGS

The invention will now be described by way of example with reference to the accompanying drawings wherein.

DESCRIPTION OF THE PREFERRED EMBODIMENTS

Figure 1:
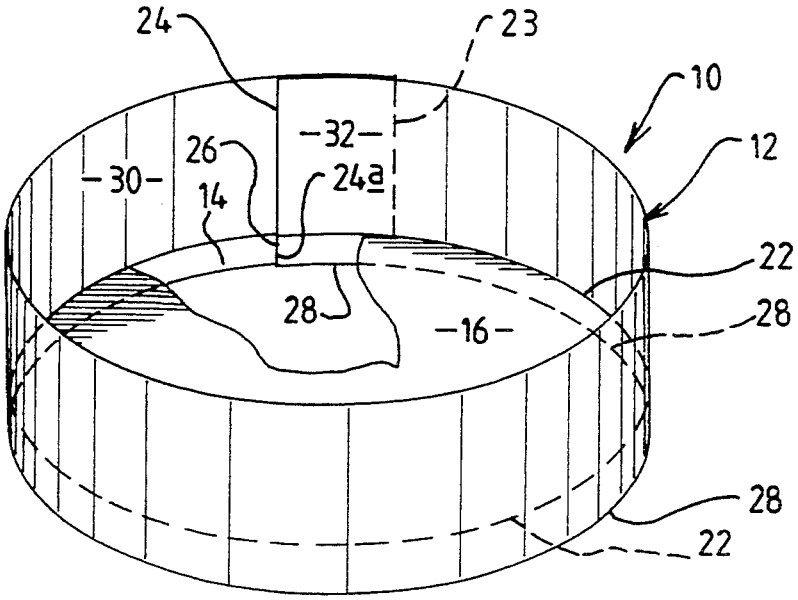
FIG. 1 shows a perspective view of a simple cylindrical container in accordance with the invention.

As illustrated in FIG. 1, a container 10 in accordance with the invention comprises a peripheral wall 12 of cylindrical form with an in-turned peripheral flange 14 which supports a disc-like transverse member or base 16.

Figures 2, 4:
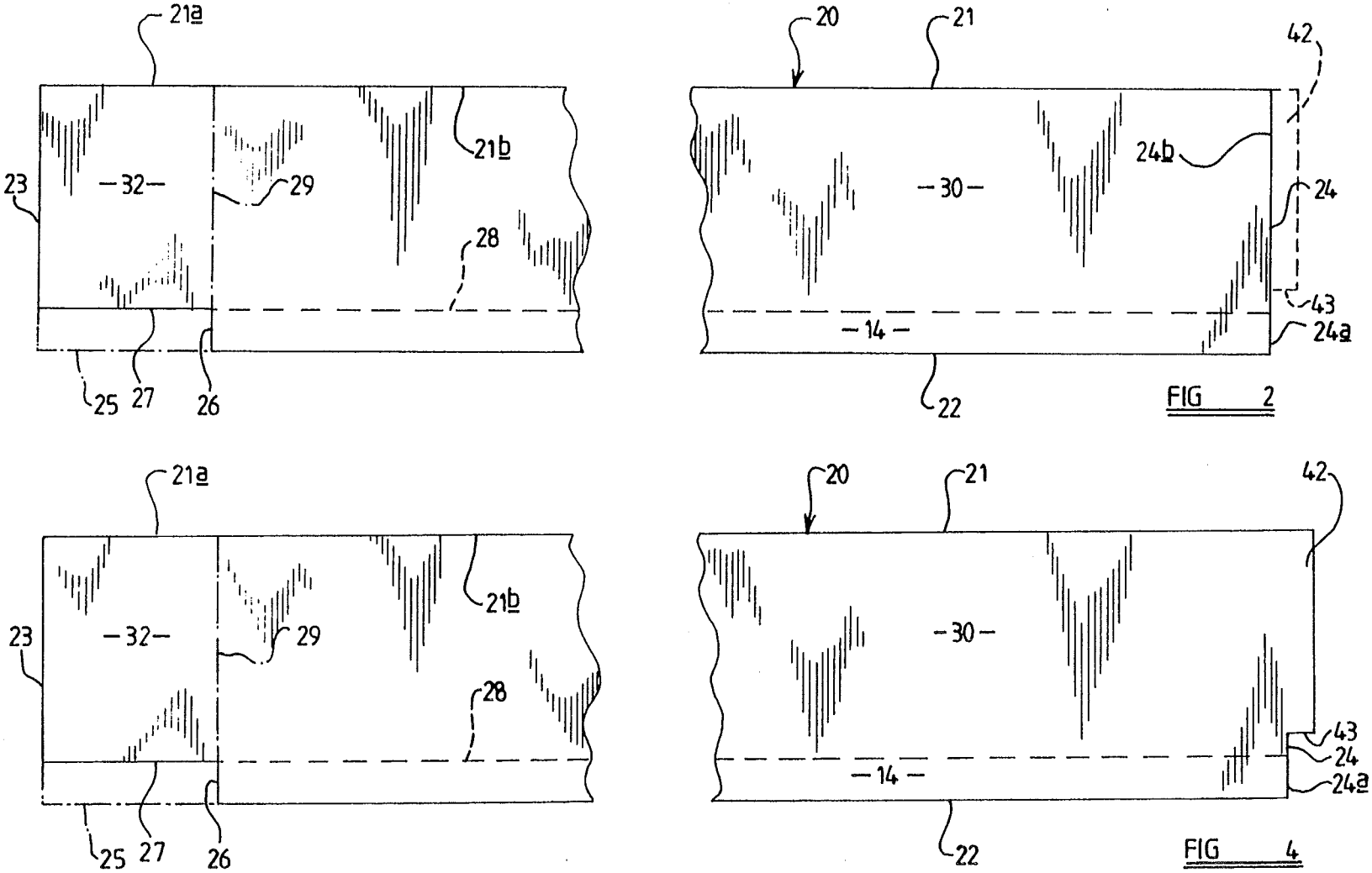
FIG. 2 shows a flat blank as used for the construction of a peripheral wall portion of such a container.
FIG. 4 shows an alternative form of flat blank.

The peripheral wall 12 is formed from a blank 20, and as illustrated in FIG. 2, the blank 20 comprises an elongated, rectangular panel with top and bottom edges 21,22 and end edges 23,24, and having a small rectangular area 25 cut away at the junction between edges 22 and 23 to define a transverse edge 26, spaced from and parallel to the end edge 23 and a longitudinal edge 27, spaced from and parallel to the lower edge 22.

A continuous score line 28 extends away from the longitudinal edge 27, parallel to the bottom edge 22 and up to the opposite end edge 24. An optional reference line 29 may be marked on the blank in line with the transverse edge 26 and parallel to the end edge 23.

The elongated, rectangular panel 30 (which is defined by the score line 28 and reference line 29 in combination with those parts 21*b*,24*b* of the top edge 21 and end edge 24 which extend away from lines 28 and 29 to meet at the corner opposite the cut away area 25) comprises a wall-forming panel with an integral extension flap 32 (which is defined by the line 29, longitudinal edge 27, end edge 23 and the end part 21*a* of the upper edge 21). The extension flap 32 is adapted to be adhesively secured in overlapping relation with an opposite end portion of the panel 30 adjacent to the end edge 24 in order to form the cylindrical wall 10 as shown in FIG. 1, with the marker line 29 in register with the end edge 24.

Prior to the attachment of the extension flap 32 to the opposite end of the panel 30 in this way, the flange 14 (which is defined between the score line 28 and the lower edge 22) is folded about score line 28 into face-to-face relation with the adjacent wall-forming panel 30 in contact with that face of the panel which will form the inner surface of the container body.

In bringing the extension flap 32 into register with the opposite end portion of the panel 30, the end edge of the now in-turned flange 14, as defined by the transverse edge 26, is brought into end-to-end abutting relation with the opposite end of the flange 34 as defined by the portion **24*a* of the end edge 24 between the score line 28 and the lower edge 22 of the blank 20**.

Bringing the opposite ends **24*a*,26 of the in-turned flange 14 into abutting relation in this way serves two purposes. Firstly, it ensures that the marker line 29 which defines one end of the wall-forming panel 30 is brought into accurate alignment with the end edge 24, so that the peripheral dimension of the wall is accurately defined. Secondly, it places the in-turned flange 14 in longitudinal compression, thereby holding it securely in its in-turned condition within the cylindrical body without the need for adhesive contact between the flange 14 and the adjacent panel 30**.

In this way, the edge 22 of the blank 20 forms an internal ledge within the cylindrical wall whereby the disc-like base 16 may be positioned so as to close one end of the body.

It is an essential feature of the present invention that the junction between the wall-forming panel 30 and the in-turned flange 14 is formed as a continuous score line; a discontinuous score line, or a line of perforations, slots or the like which extend through the entire thickness of the material, or a discontinuous or continuous crease line will not enable the in-turned flange 14 to lay against the inner face of the panel 30 in the desired manner. We have, unexpectedly, found that only a continuous score line will enable the in-turned flange to be retained in face-to-face engagement with the panel 30 in the desired manner so as to provide a firm and precise support for the base 16.

It will be appreciated that the peripheral shape of the hollow body will conform to the peripheral shape of the disc-like base member and that whilst, for simplicity in the foregoing description it has been assumed that such body is of circular form in plan view, the base member and the body may be formed in this way to any convenient shape, including oval and polygonal, in the latter case appropriate creases being formed in the panel 20 to facilitate folding thereof where required.

Further variations are also possible within the scope of the invention. For example, a second disc-like transverse member may be provided in spaced relation from the base 16 engaged on the ledge formed by the edge 22 of the in-turned flange 14. This may be achieved by positioning a peripheral band within the body resting on the base 16, thereby providing a further internal ledge to locate the further transverse member. In this case such further transverse member may be apertured to receive and locate one or more articles within the body, and a further in-turned flange may be provided at the upper edge 21 of the wall-forming panel 30 to retain the further transverse member.

Indeed such a further in-turned flange at the upper edge 21 may be provided even where no further transverse member is provided. In this case, correct alignment of the ends of the wall-forming panel would be further facilitated by the abutment of the ends of the two in-turned flanges at both top and bottom edges thereof.

Figure 3:
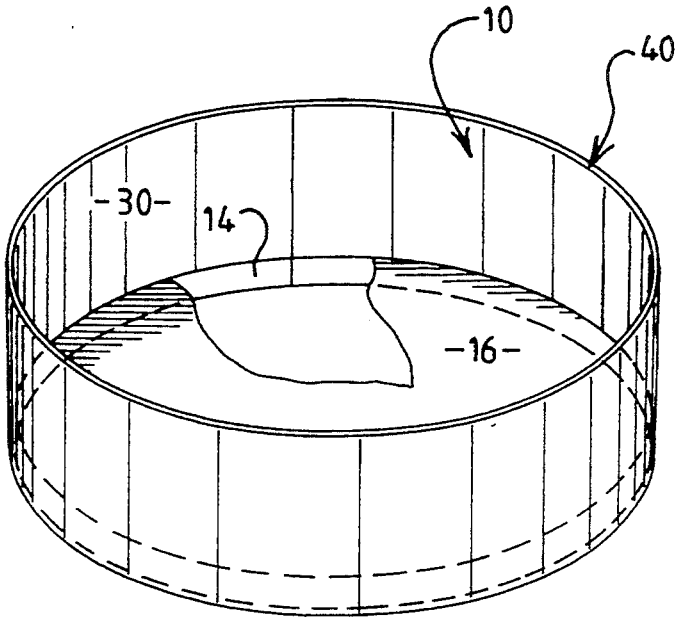
FIG. 3 shows a perspective view of an alternative form of cylindrical container which includes an outer peripheral wall and an inner liner.

In the embodiment illustrated in FIG. 3, the base 16 is supported in a similar manner by the in-turned flange 14 provided at the lower edge of the wall panel 30, but the extension flap 32 is omitted and the opposite ends of the panel 30 are simply brought into direct abutting relationship, the panel 30 in this case forming a liner which is disposed within an outer wall 40 constructed in any suitable manner and so dimensioned as to ensure that the opposite ends of the panel 30 and of the flange 14 are held together.

A further modification which may be provided, while remaining within the scope of the invention, is that as shown in FIG. 4 of the drawings the panel 30 may be provided, at its end edge 24 opposite its end provided with the extension flap 32, with a further flap 42. The flap 42 has a lower edge 43 which is disposed so as to engage the edge 22 of the in-turned flange 14 of the opposite end of the panel 30 when the panel is formed into the cylindrical wall 10 as shown in FIG. 1 of the drawings. This has the effect of ensuring that the two ends of the panel 30 when formed into the cylindrical wall 10 are readily placed into the correct alignment with one another. Thus the adjacent parts of the edge 22 of the in-turned flange 14 are aligned with one another in the direction of the height of the container.

I claim:

1. A cardboard container of substantially rigid construction comprising:

a peripheral wall panel defining a hollow body, the wall panel including an inturned flange formed along a peripheral edge thereof, the flange extending continuously along an entire length of the peripheral edge of the wall panel and being foldably and integrally connected to the wall panel by a continuous score line, the flange further having opposite ends held in abutment with one another within the hollow body such that the flange is held in a state of compression and retained within the hollow body in face-to-face engagement with the wall panel without otherwise being secured to the wall panel; and a transverse member being retained within the hollow body by the flange.

2. The container according to claim 1, wherein the wall panel includes opposed ends, one of the opposed ends of the wall panel having a first flap thereon for securing the opposed ends to one another by overlapping another of the opposed ends of the wall panel.

3. The container according to claim 1, wherein the wall panel includes opposed ends and forms an inner liner for the container, the container further including an outer wall surrounding the wall panel for holding the opposed ends of the wall panel in abutting relationship with one another.

4. The container according to claim 1, wherein the wall panel includes opposed ends, one of the opposed ends of the wall panel having a formation thereon for aligning the opposed ends of the wall panel with one another by engaging an edge of the flange at another one of the opposed ends of the wall panel.

5. The container according to claim 2, wherein the other of the opposed ends of the wall panel has a second flap thereon for aligning the opposed ends of the wall panel with one another by engaging an edge of the flange at the one of the opposed ends of the wall panel having the first flap thereon.

* * * * *